US007040048B2

(12) United States Patent
Delery et al.

(10) Patent No.: US 7,040,048 B2
(45) Date of Patent: May 9, 2006

(54) FOLDING IRONING BOARD

(75) Inventors: Richard M. Delery, Laguna Niguel, CA (US); Marylou Foley, Laguna Niguel, CA (US)

(73) Assignee: The Bag Stand Company, Ontario, CA (US)

( * ) Notice: Subject to any disclaimer, the term of this patent is extended or adjusted under 35 U.S.C. 154(b) by 136 days.

(21) Appl. No.: 10/775,354

(22) Filed: Feb. 10, 2004

(65) Prior Publication Data

US 2005/0172528 A1 Aug. 11, 2005

(51) Int. Cl.
*D06F 81/02* (2006.01)
*D06F 81/06* (2006.01)

(52) U.S. Cl. ..... 38/139

(58) Field of Classification Search ..... 38/107, 38/137, 138, 139, 106, 108, 135, DIG. 2; 108/63, 97, 135, 167; D32/66
See application file for complete search history.

(56) References Cited

U.S. PATENT DOCUMENTS

| | | | | | |
|---|---|---|---|---|---|
| 400,799 | A | * | 4/1889 | Sebold | 108/135 |
| 827,237 | A | * | 7/1906 | Hofacker | 108/135 |
| 916,554 | A | * | 3/1909 | Held | 108/167 |
| 990,586 | A | * | 4/1911 | Perry | 108/97 |
| 2,554,446 | A | * | 5/1951 | Nestor | 108/63 |
| 2,746,186 | A | * | 5/1956 | Brown | 38/138 |
| 3,039,214 | A | * | 6/1962 | Hansen | 108/63 |
| 3,268,192 | A | * | 8/1966 | Munson | 248/117.1 |
| 4,565,021 | A | * | 1/1986 | Kay et al. | 38/137 |

* cited by examiner

*Primary Examiner*—Ismael Izaguirre
(74) *Attorney, Agent, or Firm*—Blackwell Sanders Peper Martin, LLP

(57) ABSTRACT

An ironing board that folds in half to occupy only about one half its extended length to facilitate packaging and storage. An iron rest can be slid to latch the folded front and rear sections of the board. The board has front and rear legs allowing it to be set up on top of a table. The rear legs incorporate clamp mechanisms that allow the ironing board to be clamped onto a table edge so that clothing that is being pressed can hang freely from the edges of the ironing board without bunching up on the table top.

26 Claims, 4 Drawing Sheets

FOLDING IRONING BOARD

CROSS-REFERENCE TO RELATED APPLICATIONS

None.

STATEMENT REGARDING FEDERALLY SPONSORED RESEARCH OR DEVELOPMENT

None.

FIELD OF THE INVENTION

This invention relates generally to ironing boards and more particularly to an improved ironing board that is constructed in a unique manner to facilitate its packaging, storage and use.

BACKGROUND OF THE INVENTION

Conventional ironing boards have lengthy folding legs or stands that can be extended to allow the ironing board to be supported on the floor at a height convenient for use. Even when the ironing board legs are retracted, the board is lengthy such that it occupies considerable space when offered for sale in retail stores. This is a significant drawback because of the premium that is placed on space in many retail stores of the type that carry ironing boards. Shipping such lengthy items also creates difficulties, as does storing long ironing boards in households when they are not being used.

Ironing boards have been constructed with shorter legs that are intended to allow use of the ironing board on top of a table. While this type of construction is advantageous when there is inadequate floor space available, or when it is otherwise inconvenient to use the ironing board on the floor, the ironing board is still lengthy and thus subject to the same problems regarding shipping, storage and occupying excessive space in stores. Further, tabletop ironing boards are so close to the tabletop that clothes resting on the ironing surface do not hang freely but instead tend to bunch up on top of the table. This bunching effect makes it more difficult to iron the clothes effectively and adds to the time required to press them.

BRIEF SUMMARY OF THE INVENTION

The present invention is directed to an ironing board that is constructed in a manner that results in significant advantageous over other ironing boards a variety of respects.

More particularly, it is an object of the invention to provide an ironing board that can be folded on itself when not in use so that its length when folded is only about half its length when unfolded for use. Consequently, the ironing board can be packaged in a relatively short package and occupies a minimum amount of space when shipped, stored or displayed on retail shelves or elsewhere in stores.

Another object of the invention is to provide an ironing board of the character described that can be latched in the folded condition and easily unlatched to allow it to be unfolded for use.

Still another and related object of the invention is to provide an ironing board of the character described in which an iron rest serves as the latching mechanism. By using the iron rest for two separate functions, the overall complexity is reduced, as is the number of parts required.

A further object of the invention is to provide an ironing board that can be attached securely to an edge portion of a table so that the ironing surface is largely to the side of the table, thus allowing clothes to be placed on the ironing surface to hang freely without bunching up on the tabletop.

Yet another object of the invention is to provide an ironing board that can be clamped to a table edge, or, alternatively, used on top of a table. This versatility exhibited by the ironing board is a significant advantage over the types of structures that have been used in the past.

An additional object of the invention is to provide an ironing board of the character described in which the clamp mechanism is formed as part of the leg assembly that supports the ironing board on top of a table when used that way. By constructing the leg assembly to serve two different functions, undue complexity and the need for added parts is avoided.

Among the other objects of the invention are to provide an ironing board that is characterized by legs that can be quickly and easily folded and unfolded, a clamp mechanism that can be easily applied to and released from a table edge, a board structure that can be quickly and easily folded and unfolded and latched in the folded condition while being easily unlatched, and a construction that allows the entire unit to assume a compact condition to facilitate storage, packaging and shipping.

Other and further objects of the invention, together with the features of novelty appurtenant thereto, will appear in the course of the following description.

BRIEF DESCRIPTION OF THE SEVERAL VIEWS OF THE DRAWING

In the accompanying drawings which form a part of the specification and are to be read in conjunction therewith and in which like reference numerals are used to indicate like parts in the various views.

DETAILED DESCRIPTION OF THE INVENTION

Figure 1:
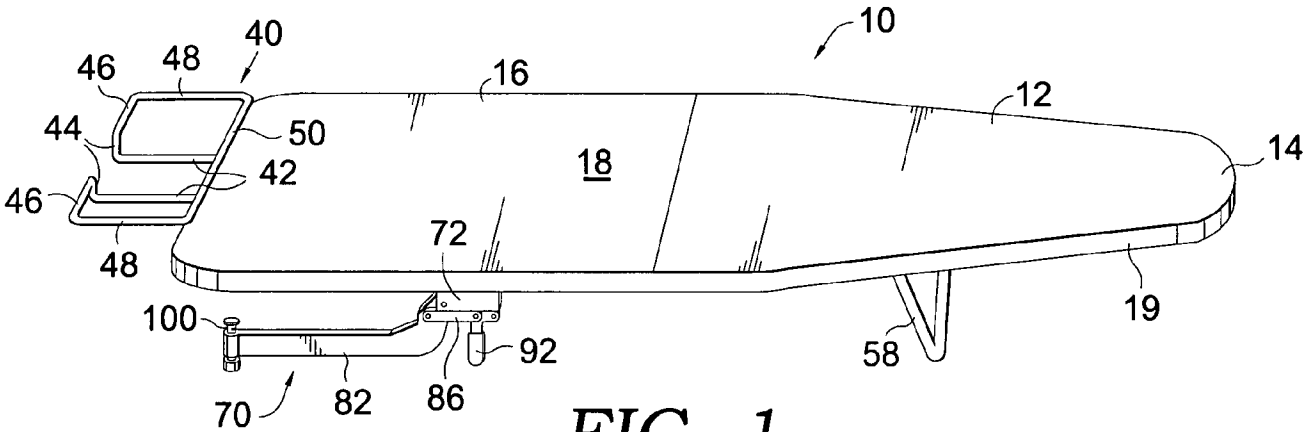
FIG. 1 is a perspective view of an ironing board constructing according to a preferred embodiment of the present invention, with the ironing board unfolded for use and the front and rear legs extended to allow the ironing board to be used on top of the table.
Figure 2:
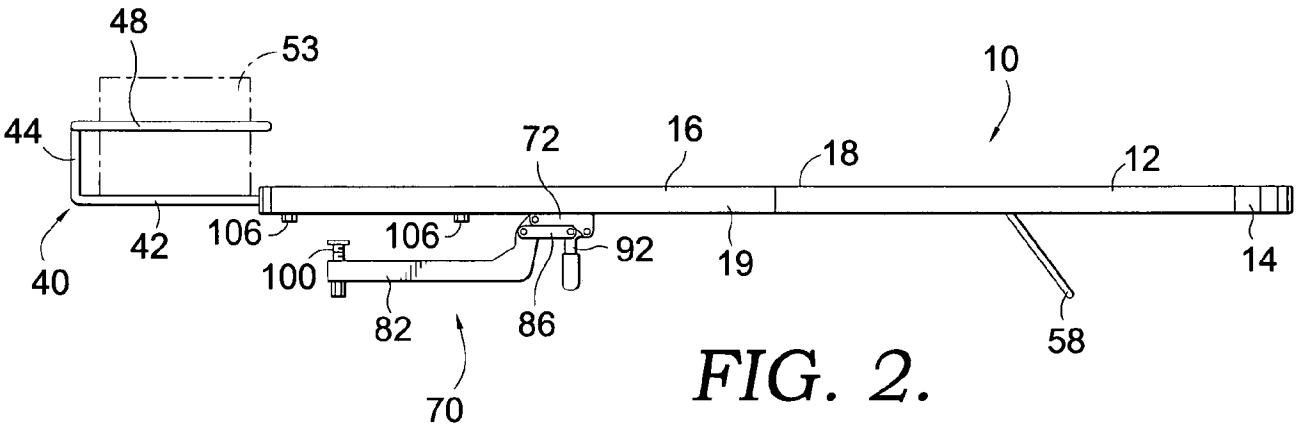
FIG. 2 is a side elevational view of the ironing board shown in FIG. 1.

Referring now to the drawings in more detail and initially to FIGS. 1 and 2 in particular, the present invention is directed to an improved ironing board, a preferred embodiment of which is generally identified by numeral 10. The ironing board 10 includes a front section 12 which tapers from its back end portion toward a rounded nose 14 formed on the front end portion of section 12. The ironing board 10 also has a rear section 16 which is located adjacent to the back end of section 12 and is generally rectangular with rounded rear corners. The ironing board sections 12 and 16 may be constructed of any suitable material and may have a body formed by a mesh panel 17 (FIG. 3) equipped in the peripheral flange 19. The panel 17 and flange 19 may be covered suitably to provide a convenient surface for pressing clothes. When the ironing board sections 12 and 16 are in the position shown in FIGS. 1 and 2, they cooperate to present a continuous flat upper surface 18 on which clothes may be placed for ironing. The sections 12 and 16 have approximately the same length from front to back.

As best shown in FIGS. 5–8, the ironing board sections 12 and 16 are connected end to end by hinges, one of which is identified by numeral 20. The back end of the hinge 20 is pivoted at 22 to the flange 19 near the front end portion of the rear ironing board section 16 at a location on the underside of the ironing board 10. The front end of hinge 20 is provided with an elongated slot 24 through which a pin 26 on the flange 19 of the front ironing board section 12 extends. The pin 26 is parallel to pin 22 such that the hinge 20 can pivot about the horizontal axes of the parallel pins 22 and 26.

Figure 5:
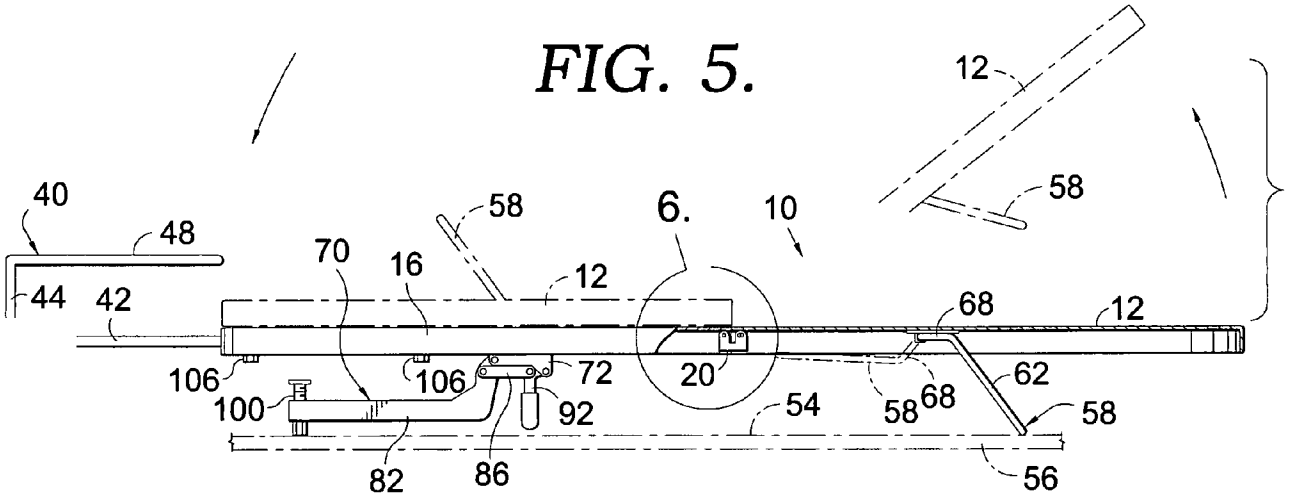
FIG. 5 is a side elevational view similar to FIG. 2 showing the ironing board resting on a tabletop, with the broken lines indicating folding of the ironing board to its storage position and the iron rest moved to its latching position for latching of the ironing board in the folded position.
Figure 8:
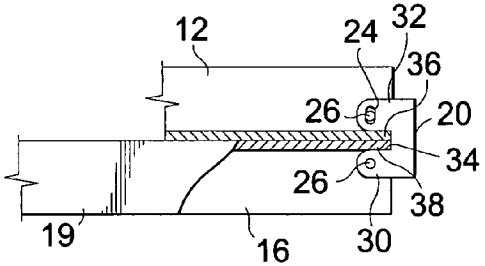
FIG. 8 is a fragmentary elevational view similar to FIGS. 6 and 7, but showing the ironing board in its fully folded condition.
Figure 7:
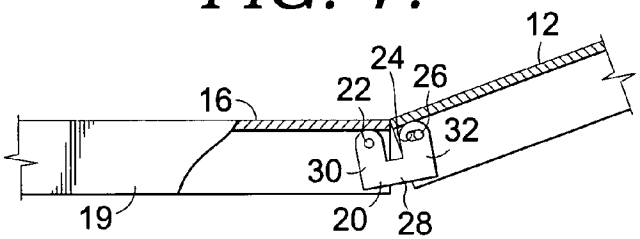
FIG. 7 is a fragmentary elevational view similar to FIG. 6, but showing the ironing board folded slightly from its fully unfolded condition.

The hinge 20 allows the ironing board 10 to be folded about the hinge to a storage position shown in FIG. 8 and in broken lines in FIG. 5. When the ironing board is in the fully folded position of FIG. 8, the flat upper surfaces of the ironing board section 12 and 16 lie flatly against one another with the nose 14 of the front section substantially coincident with the back edge of the rear section 16. As best shown in FIG. 7, when the front section is initially pivoted from the unfolded position toward the folded position, the elongated configuration of the slot 24 allows pin 26 to slide within the slot so that the hinge does not bind and the ironing board can be freely folded until the front section 12 overlies the rear section 16 in the fully folded position shown in FIG. 8. When the ironing board is in the fully folded position, its length is substantially one-half its length in the unfolded position.

Figure 6:
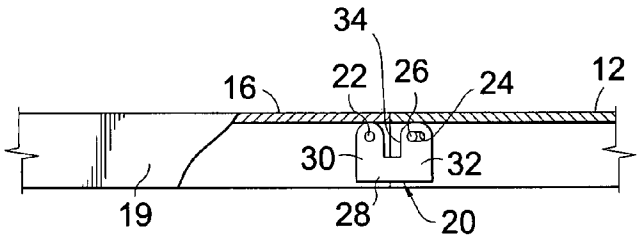
FIG. 6 is a fragmentary elevational view on an enlarged scale of the detail indicated by numeral 6 in FIG. 5, with a portion broken away for purposes of illustration.

With continued reference to FIGS. 6–8 in particular, the hinge 20 is a generally U-shaped structure having a base 28 and a pair of spaced apart legs 30 and 32 projecting from the base and presenting a space 34 between the legs. The slot 24 is located near the upper end of leg 32. The pin 22 extends through an opening in leg 30 near its upper end in a manner allowing the hinge 20 to pivot about the axis of pin 22. The provision of the space 34 accommodates folding and unfolding of the ironing board 10 without binding or other difficulties. When the ironing board is in the fully folded position shown in FIG. 8, the back edge 36 of the front ironing board section and the front edge 38 of the rear ironing board section fit closely in the space 34. The elongated shape of the slot 24 facilitates unfolding of the ironing board from the position of FIG. 8 by accommodating the necessary play of the pin 26 in the slot 24.

The ironing board 10 is equipped with an iron rest which is generally identified by numeral 40. The iron rest 40 may be constructed as an integral rod bent into a shape that is common for iron rests. A pair of parallel rods 42 form the lower portion of the iron rest 40. Extending upwardly from the back ends of the rods 42 are a pair of vertical legs 44 which connect at their upper ends with outwardly extending arms 46. Extending forwardly from the outer ends of the arms are opposite side rods 48 which are parallel to one another on the opposite sides of the iron rest 40. A horizontal cross rod 50 extends between the forward ends of the side rods 48.

Figure 3:
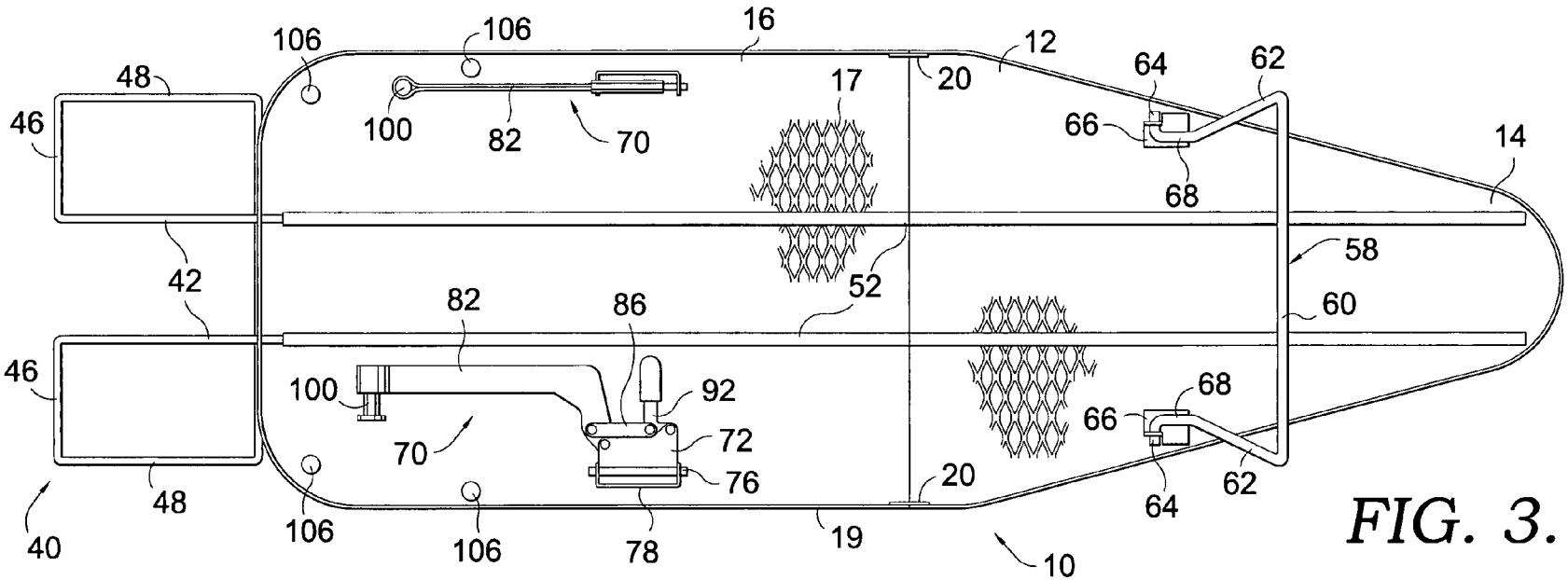
FIG. 3 is a bottom plan view on an enlarged scale of the ironing board shown in FIGS. 1 and 2, with one of the rear legs in its retracted position lying against the underside of the ironing board.

As best shown in FIG. 3, the forward ends of the rods 42 are received in a pair of parallel channels or tubes 52 secured to the underside of panel 17 on the rear ironing board section 16. The rods 42 are axially slidable in the tubes 52 so that the iron rest 40 can be moved fore and aft between the position shown in FIGS. 1–3 and a latching position which is shown in broken lines in FIG. 5. In the position of FIGS. 1–3, an iron (shown fragmentarily in FIG. 2 and identified by numeral 53) can be received on the iron rest 40, with the iron 53 resting on the rods 42 and contained within the side rods 48, the arms 46 and the cross rod 50. The position shown in FIG. 5 is a latching position in which the ironing board is releaseably latched in the folded condition. When the front section 12 is folded onto the rear section 16, the iron rest 40 can be slid forwardly to the latching position of FIG. 5 wherein the side rods 48 and cross rod 50 fit closely on top of the nose area 14 of the front section in order to prevent it from being unfolded until the iron rest 40 is again slid rearwardly to release it.

As best shown in FIG. 5, the ironing board 10 may be used on the upper surface 54 of a tabletop 56. The front section 12 is provided with a pivotal front leg which is generally identified by numeral 58. With additional reference to FIG. 4, the leg 58 may take the form of a bent rod and includes a horizontal base 60 that rests on the table surface 54 when the ironing board is set up on the table. A pair of legs 62 extend from the opposite ends of the base 60 and terminate at their opposite ends in axially aligned out turned end portions 64. The end portions 64 are fitted through openings in brackets 66 secured to panel 17 on the underside of the front section 12 in a manner allowing the leg 58 to be pivoted between the extended position shown in solid lines in FIG. 5 and the retracted position shown in broken lines in FIG. 5. In the extended position, the leg 58 is retained in a stable position by bent upper ends 68 (FIG. 5) of the arms, contacting on the panel 17 on the underside of the front section 12. In the folded or retracted position of the leg structure 58, the leg structure is folded up and lies against the underside of panel 17 generally inside of the flange 19.

Figure 4:
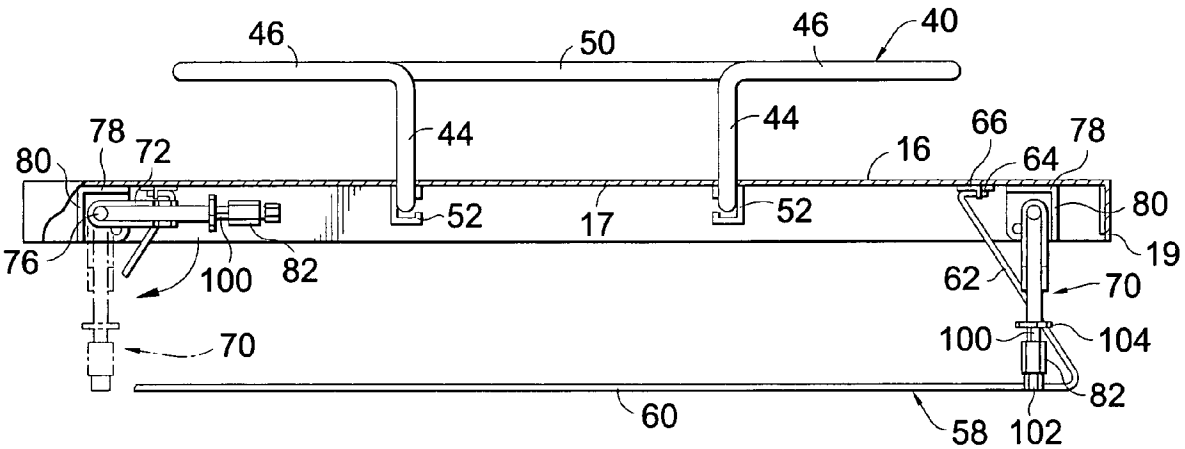
FIG. 4 is a rear elevational view on an enlarged scale of the ironing board shown in FIGS. 1–3, with the broken line position of one of the rear legs indicating its extended position for use of the ironing board on top of a table.

The rear ironing board section 16 is provided with a pair of rear leg structures generally identified by numeral 70. Each of the rear leg structures 70 includes a bracket 72 having a sleeve 74 which receives a horizontal pin 76 mounted to the underside of panel 17 on section 16. The pin 76 fits through the sleeve 74 in a manner allowing the bracket 72 to be pivoted through an arc of approximately 90° between the positions shown in solid lines and broken lines in FIG. 4 for the leg structure 70 shown on the left. The solid line position of FIG. 4 is a retracted storage position, whereas the broken line position shown in FIG. 4 is an extended position in which the leg structure 70 serves to support the rear part of the ironing board on the table surface 54. The pins 76 provide parallel axes about which the brackets 72 of the two rear leg structures 70 can pivot. The pins 76 may be mounted on brackets 78 (FIG. 4) each having a vertical flange 80 that forms a stop preventing the leg structure 70 from pivoting beyond the fully extended position shown in broken lines in FIG. 4.

Figure 9:
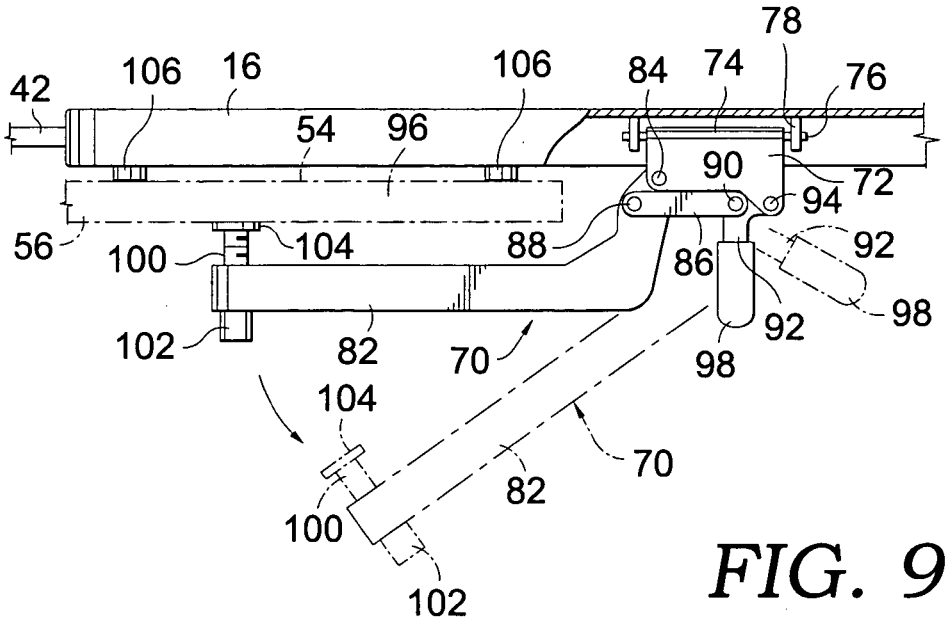
FIG. 9 is a fragmentary side elevational view on an enlarged scale of the rear portion of the ironing board showing an edge portion of a table to which the ironing board is clamped, with the broken lines indicating release of the clamp mechanism from the table.
Figure 10:
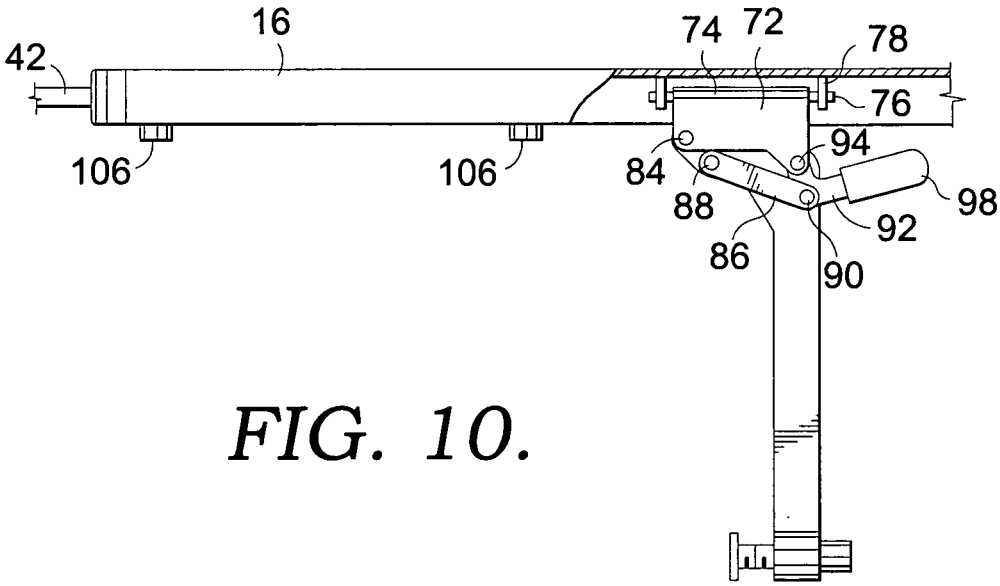
FIG. 10 is a fragmentary elevational view similar to FIG. 9, but showing the clamp mechanism fully pivoted away from its clamping position.

As best shown in FIGS. 9 and 10, each leg structure 70 include an L-shaped arm 82 which has a horizontal pivot connection at 84 with the bracket 72. A link 86 is pivoted at one end to the end portion of arm 82 by a horizontal pin 88 that is offset from pin 84. The opposite end of link 86 is pivoted at 90 to the upper end of an L-shaped handle 92. The handle 92 is pivoted at 94 to the bracket 72 at a location offset from pin 90. The pins 84, 88, 90 and 94 are parallel to one another and cooperate with the other parts to provide an over center linkage for clamping the arm 82 onto an edge portion 96 (FIG. 9) of the tabletop 56.

The lower end portion of the handle 92 is provided with a cover 98 that may be constructed of rubber or a similar material that provides a hand grip. The end of the arm 82 remote from the bracket 72 carries a leveling leg 100 which is treaded through the end portion of the arm 82 and carries a padded foot 102 on its lower end at a location below the arm 82. The upper end of the leveling leg 100 is provided with a flat head 104.

When the leg structures 70 are in the position shown in FIG. 5, they provide rear legs for support of the ironing board 10 on the tabletop 54. The linkage included in each leg structure 70 locks the leg structure in a position in which the arm 82 extends generally horizontally and the foot 102 can rest on top of the table surface 54 such that the ironing surface 18 provided on top of the ironing board 10 has a horizontal orientation and is spaced a short distance above the table surface 54 at a convenient height for use in the ironing of clothes.

The leg structures 70 serve the additional purpose of providing a clamp mechanism that can be used to clamp the ironing board 10 onto an edge portion of a table such as the edge portion 96 shown in FIG. 9. In order to apply the clamp mechanism to the table edge portion 96, the handle 92 can be gripped by hand and pivoted from the solid line position of FIG. 9 to the broken line position of FIG. 9. As the handle is rotated about its pivot pin 94, it pulls the pin 90 downwardly and rotates pin 90 in an arc about the axis of pin 94, thus pulling pin 88 in a counterclockwise direction about the axis of pin 84. The link 86 thus pivots arm 82 in a counterclockwise direction about the axis of pin 84 so that the clamp mechanism is released when the arm is pivoted, for example, to the broken line position of FIG. 9.

With the clamp mechanism in the release position, the rear section 16 of the ironing board can be applied on top of the edge portion 96 as shown in FIG. 9, with pads 106 on the underside of the ironing board preferably projecting below the flange 19 to contact the upper surface 54 of the tabletop. FIG. 10 shows the clamp mechanism pivoted to its extreme position, but it is noted that the clamp mechanism need not be pivoted to this extreme position but can simply be pivoted far enough away from the clamping position (solid lines in FIG. 9) to allow the ironing board to be applied to the table edge portion 96 with the arm 82 fitting beneath the edge portion 96.

To clamp the ironing board onto the edge portion 96, the handle 92 is gripped with the hand and pivoted in a clockwise direction to the solid line position shown in FIG. 9. This moves pin 90 in a clockwise direction about pin 94 until pin 90 is in line with or preferably above a straight line extending between pins 88 and 94. Then, the arm 82 is generally horizontal. The over center construction of the linkage for the clamp mechanism (pin 90 being on or above a straight line extending between pins 88 and 94) provides a latching effect which latches the clamp mechanism in the solid line clamping position of FIG. 9. In this position, the head 104 of each of the leveling legs 100 is engaged against the underside of the table edge portion 96, with the ironing board 10 securely clamped in place due to the clamping effect of the rubber pads 106 on top of the table surface and the leveling leg heads 104 applied against the underside of the edge portion 96.

When the ironing board 10 is clamped onto the table in this fashion, the ironing surface provided on its upper surface is generally horizontal so that ironing can be carried out at a convenient height. At the same time, clothes that are applied to the ironing surface of the ironing board are able to hang downwardly from the ironing board below the table top 54, thus avoiding bunching of the clothes on top of the table which can impair ironing of the clothes. However, the ironing board can also be placed on top of the table 56 and used in this fashion, as best shown in FIG. 5.

The leveling leg 100 may be adjusted up or down due to its threaded connection with the end of the arm 82. In order to extend the foot 102 downwardly if necessary for leveling of the ironing surface when the ironing board is applied on top of a table, the leg 100 can be threaded to extend the foot 102 downwardly. In order to increase the force of the clamping action when the ironing board is clamped onto a table edge, the leveling leg 100 can be threaded in the opposite direction to move the head 104 upwardly and thereby apply a stronger clamping force when the clamp mechanism is moved to its clamping position.

The rear leg structure 70 can be pivoted to the storage position shown in solid lines in FIG. 4 for the left leg structure 70. This is accomplished by pivoting the bracket 72 about pin 76 until the bracket and arm 82 lay generally flatly against the underside of panel 17 on the rear section 16 with the leg structures located substantially within the flange 19. The front leg 58 can be stored in the broken line position shown in FIG. 5, and the front section 12 can be folded back on the rear section 16 to the storage position shown in broken lines in FIG. 5. The iron rest 40 can then be slid forwardly to latch the ironing board in the folded position in which it occupies only approximately one-half its length when it is unfolded for use.

Consequently, the ironing board of the present invention can be packaged in its folded condition in a package having only approximately one-half the length of a package needed for packaging of a full length ironing board, and shipping and storage of the ironing board in households is similarly facilitated due to the compact condition of the ironing board when it is folded up to the storage position.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. An ironing board comprising:

a front ironing board section having a generally flat upper surface and a length dimension; and a rear ironing board section having a generally flat upper surface and a length dimension substantially equal to the length dimension of said front section, said front and rear sections being connected generally end to end for hinged movement between an ironing position wherein said upper surfaces of the front and rear sections present a substantially continuous planar surface for ironing and a folded storage position wherein said upper surfaces of the front and rear sections lie substantially against one another, said length dimensions of said front and back sections substantially coinciding in the storage position and said planar surface having a length dimension substantially equal to twice the length dimensions of said front and rear sections.

2. An ironing board as set forth in claim 1, including releasable means for latching said front and rear sections in said storage position.

3. An ironing board as set forth in claim 1, including an iron rest on said rear ironing board section mounted thereon for movement between a first position for holding an iron thereon and a second position wherein said iron rest latches said front and rear sections in said storage position.

4. An ironing board as set forth in claim 3, wherein said iron rest is mounted on said rear section for linear sliding movement between said first and second positions.

5. An ironing board as set forth in claim 1, including a clamp mechanism on one of said sections applicable to an edge portion of a table to detachably clamp said sections to the table with said upper surface in a substantially horizontal orientation.

6. An ironing board as set forth in claim 5, wherein said clamp mechanism includes a plurality of legs constructed to support said sections in an alternative position on top of the table when unclamped therefrom.

7. An ironing board as set forth in claim 5, including front and rear legs applicable to the table to support said sections in an alternative position on top of the table.

8. An ironing board as set forth in claim 1, including a generally U-shaped hinge connecting said front and rear sections for hinged movement between said ironing position and said storage position, said hinge including a pair of legs pivoted to the respective front and rear sections and presenting a space between said legs in which adjacent edges of said sections are closely received in the storage position.

9. An ironing board as set forth in claim 8, including a slot and a pin received in said slot providing a pivot connection for said hinge to one of said sections, said pin being movable linearly in said slot to provide play between the hinge and said pip for facilitating movement between said ironing position and said storage position.

10. An ironing board structure for use with a table having an edge portion, said structure comprising:

an ironing board presenting a generally flat upper surface for ironing;

a leg structure on said ironing board constructed to support said board on said top surface of the table in a first position with said leg structure resting on said top surface and said upper surface of the ironing board spaced above said top surface in a substantially horizontal orientation; and a clamp mechanism on said board applicable to said edge portion of the table to detachably secure said board to said table in a second position with said upper surface in a substantially horizontal orientation.

11. A structure as set forth in claim 10, wherein said clamp mechanism presents a support leg applicable to the table to support said board on the table in an alternative position when said clamp mechanism is released from the table.

12. A structure as set forth in claim 10, wherein said clamp mechanism includes an over center linkage operable to releaseably clamp said clamp mechanism to the table.

13. A structure as set forth in claim 10, wherein said clamp mechanism is connected with said board for movement between a clamping position wherein the board is clamped onto said edge portion and a storage position wherein said clamp mechanism is retracted for storage lying against an underside of the board.

14. A structure as set forth in claim 10, wherein said ironing board includes:

a front section; and a rear section connected generally end to end with said front section for hinged movement between an ironing position wherein said front and rear sections cooperate to present said generally flat upper surface and a folded storage position wherein said front and rear sections lie substantially face to face against one another.

15. A structure as set forth in claim 10, including a clamp adjustment on said clamp mechanism that allows the clamping force applied to the table by said clamp mechanism to be adjusted.

16. Ironing board apparatus for use with a table having an edge portion and a top surface, said apparatus comprising:

an ironing board presenting a generally flat ironing surface; and a leg structure on said ironing board constructed to support said board on said top surface of the table in a first position with said ironing surface spaced above said top surface in a substantially horizontal orientation, said leg structure including a clamp mechanism applicable to said edge portion of the table to detachably secure said ironing board to said table in an alternative second position wherein said ironing surface is in a substantially horizontal orientation clamped to said edge portion.

17. Apparatus as set forth in claim 16, wherein said leg structure includes:

a front leg; and a pair of spaced apart rear legs each having said clamping mechanism thereon.

18. Apparatus as set forth in claim 17, including a leveling adjustment on each of said rear legs that allows adjustment of said ironing surface relative to a horizontal orientation thereof.

19. Apparatus as set forth in claim 17, wherein said front leg and each of said rear legs is connected with said board for movement between an extended position for application to the top surface of the table to support the board thereon and a retracted position wherein said legs are retracted to lie adjacent to an underside of the board for storage.

20. An ironing board comprising:

a front ironing board section having a generally flat upper surface;

a rear ironing board section having a generally flat upper surface, said front and rear sections being connected generally end to end for hinged movement between an ironing position wherein said upper surfaces of the front and rear sections present a substantially continuous planar surface for ironing and a folded storage position wherein said upper surfaces of the front and rear sections lie substantially against one another; and a clamp mechanism on one of said sections applicable to an edge portion of a table to detachably clamp said sections to the table with said upper surface in a substantially horizontal orientation, said clamp mechanism including a plurality of legs constructed to support said sections in an alternative position on top of the table when unclamped therefrom.

21. An ironing board comprising:

a front ironing board section having a generally flat upper surface;

a rear ironing board section having a generally flat upper surface, said front and rear sections being connected generally end to end for hinged movement between an ironing position wherein said upper surfaces of the front and rear sections present a substantially continuous planar surface for ironing and a folded storage position wherein said upper surfaces of the front and rear sections lie substantially against one another;

a clamp mechanism on one of said sections applicable to an edge portion of a table to detachably clamp said sections to the table with said upper surface in a substantially horizontal orientation; and front and rear legs applicable to the table to support said sections in an alternative position on top of the table.

22. An ironing board comprising:

a front ironing board section having a generally flat upper surface;

a rear ironing board section having a generally flat upper surface, front and rear sections being connected generally end to end for hinged movement between an ironing position wherein said upper surfaces of the front and rear sections present a substantially continuous planar surface for ironing and a folded storage position wherein said upper surfaces of the front and rear sections lie substantially against one another; and a generally U-shaped hinge connecting said front and rear sections for hinged movement between said ironing position and said storage position, said hinge including a pair of legs pivoted to the respective front and rear sections and presenting a space between said legs in which adjacent edges of said sections are closely received in the storage position.

23. An ironing board structure for use with a table having an edge portion, said structure comprising:

an ironing board presenting a generally flat upper surface for ironing; and a clamp mechanism on said board applicable to said edge portion of the table to detachably secure said board to said table with said upper surface in a substantially horizontal orientation, said clamp mechanism presenting a support leg applicable to the table to support said board on the table in an alternative position when said clamp mechanism is released from the table.

24. An ironing board structure for use with a table having an edge portion, said structure comprising:

an ironing board presenting a generally flat upper surface for ironing; and a clamp mechanism on said board applicable to said edge portion of the table to detachably secure said board to said table with said upper surface in a substantially horizontal orientation, said clamp mechanism being connected with said board for movement between a clamping position wherein the board is clamped onto said edge portion and a storage position wherein said clamp mechanism is retracted for storage lying against an underside of the board.

25. An ironing board structure for use with a table having an edge portion, said structure comprising:

an ironing board presenting a generally flat upper surface for ironing;

a clamp mechanism on said board applicable to said edge portion of the table to detachably secure said board to said table with said upper surface in a substantially horizontal orientation;

a front section of said ironing board; and a rear section of said ironing board connected generally end to end with said front section for hinged movement between an ironing position wherein said front and rear sections cooperate to present said generally flat upper surface and a folded storage position wherein said front and rear sections lie substantially face to face against one another.

26. Ironing board apparatus for use with a table having an edge portion and a top surface, said apparatus comprising:

an ironing board presenting a generally flat ironing surface; and a leg structure on said ironing board constructed to support said board on said top surface of the table with said ironing surface spaced above said top surface in a substantially horizontal orientation, said leg structure including a clamp mechanism applicable to said edge portion of the table to detachably secure said ironing board to said table in an alternative position wherein said ironing surface is in a substantially horizontal orientation clamped to said edge portion, said leg structure including a front leg and a pair of spaced part rear legs each having said clamping mechanism thereon.

* * * * *